US005084846A

United States Patent [19]

Smith, Jr.

[11] Patent Number: 5,084,846

[45] Date of Patent: Jan. 28, 1992

[54] DEEP SUBMERGENCE HYDROPHONE

[75] Inventor: Daniel P. Smith, Jr., East Lansing, Mich.

[73] Assignee: Sparton Corporation, Jackson, Mich.

[21] Appl. No.: 156,485

[22] Filed: Feb. 16, 1988

[51] Int. Cl.[5] ..... H04R 1/02

[52] U.S. Cl. ..... 367/153; 367/188

[58] Field of Search ..... 367/2, 4, , 5, 6, 14, 367/15, 16, 17, 18, 19, 106, 129, 130, 141, 153, 155, 156, 159, 165, 166, 167, 171, 172, 173, 178, 180, 188, 910; 181/110, 112, 122, 402

[56] References Cited

U.S. PATENT DOCUMENTS 3,445,809 5/1969 McLoad ..... 367/188
3,539,979 11/1970 Crall ..... 367/106
3,736,557 5/1973 Brynk ..... 340/85 X
3,740,909 3/1973 Sikora ..... 340/8 R
3,980,985 9/1976 Dale et al. ..... 340/85
4,004,266 1/1977 Cook et al. ..... 367/153
4,328,569 5/1982 Trott et al. ..... 367/103

*Primary Examiner*—Brian S. Steinberger
*Attorney, Agent, or Firm*—Reising, Ethington, Barnard, Perry & Milton

[57] ABSTRACT

A hydrophone with crossed pairs of geophones is provided with a strong light weight housing allowing use at several thousand feet deep in the ocean while still maintaining good sensitivity. The cruciform housing has a cylindrical portion conforming to each of the four geophones so that each cylindrical wall has small diameter and requires small thickness. The cylindrical portions are joined to a central body to complete the housing.

4 Claims, 1 Drawing Sheet

DEEP SUBMERGENCE HYDROPHONE

FIELD OF THE INVENTION

This invention relates to a hydrophone for sensing underwater signals and particularly to such a hydrophone for deep submergence deployment and high sensitivity.

BACKGROUND OF THE INVENTION

Underwater sound sensing transducers, such as hydrophones and the like, normally employ elements sensitive to sound pressure waves created in the water by a sound source, such as an explosion, a propeller or the like. Underwater sound sensing devices of the motion detecting type known as seismic geophones have been successfully employed to sense the presence and direction of underwater sound pressure waves. A geophone contains a suspended mass within a housing and a sensor arrangement to sense any relative movement in a particular direction between the mass and the housing. The sensor generates corresponding electrical signals which are transmitted to a remote location for analysis to obtain information about the sound source. The sensor is usually a magnetic or a piezoelectric type as is well known in the art. For the purposes of this discussion the geophones are assumed to be positioned to sense the horizontal component of pressure waves. Typically, they are cylindrical and respond to sound components along their axes.

The sensitivity of these sound detecting devices depends on the mass of the seismic body, the mass of the housing, and the frontal area of the housing. A small housing mass, of course accelerates more readily than a large mass to produce a sensible displacement. On the other hand a body with a large frontal area is affected more by a sound wave. In order for the housing to undergo an acceleration to produce a displacement, a force must be applied to the housing to react with the mass of the housing. The force is developed by the sound pressure wave gradient across the housing acting on the effective frontal area of the housing. The frontal area may be considered to be the area of the projection of the housing onto a plane perpendicular to the horizontal component of the sound. Thus it is desirable to maintain a substantial frontal area while minimizing the mass of the housing to increase the sensitivity.

The prior U. S. Pat. Nos. 3,720,909 to Sikora and 3,980,985 to Dale reveal hydrophones of the kind just described. Sikora teaches the desirability of minimizing the mass. These systems have cylindrical housings with vertical axes and include buoyancy chambers above and below the geophones which add to the mass of the housing as well as to the frontal area. The cylindrical housing design has proven to be effective for use at moderate depths. A reasonable wall thickness can be used for the housing since pressure on the housing is not extreme at moderate depths. On the other hand, deep submergence hydrophones encounter pressures of several thousand pounds per square inch. The wall thickness cannot be increased enough to withstand such pressures without unacceptable increase in mass and consequent loss in sensitivity.

SUMMARY OF THE INVENTION

It is therefore an object of the invention to provide a hydrophone structure for very high pressure usage. It is a further object to provide such a structure having low mass and high sensitivity.

The invention is carried out by a hydrophone for deployment at deep sea levels and subject to high pressures comprising; first and second pairs of geophones arranged in a cross-like configuration, and a low mass cruciform housing for withstanding the high pressure having a cylindrical wall substantially conforming to each geophone, each wall having a proximal end and a distal end, an end cap closing the distal end of each cylindrical wall, and a central body joining the proximal ends of the walls, whereby the housing area subject to pressure is minimized allowing thin wall high strength construction and minimized housing mass.

BRIEF DESCRIPTION OF THE DRAWINGS

The above and other advantages of the invention will become more apparent from the following description taken in conjunction with the accompanying drawings wherein like references refer to like parts and wherein.

DESCRIPTION OF THE PREFERRED EMBODIMENT

Figure 1:
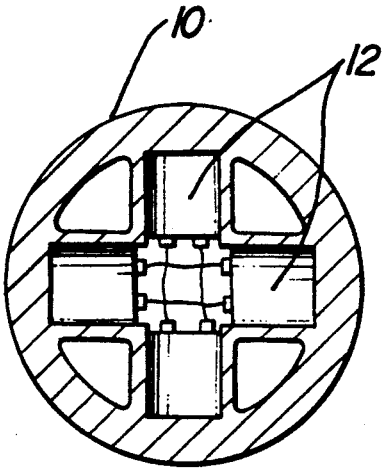
FIG. 1 is a cross section of a prior art hydrophone.

The aforementioned U.S. Pat. No.3,720,909 to Sikora which is incorporated herein by reference reveals, as shown in FIG. 1, a directional hydrophone comprising a cylindrical housing 10 containing two pairs of axially aligned geophones 12 with one pair perpendicular to the other so that the four geophones 12 are disposed in the form of a cross. The wall of the housing is sufficiently thick to withstand the pressure at moderate depths. The present invention embodies the same arrangement of sensors.

Figure 2:
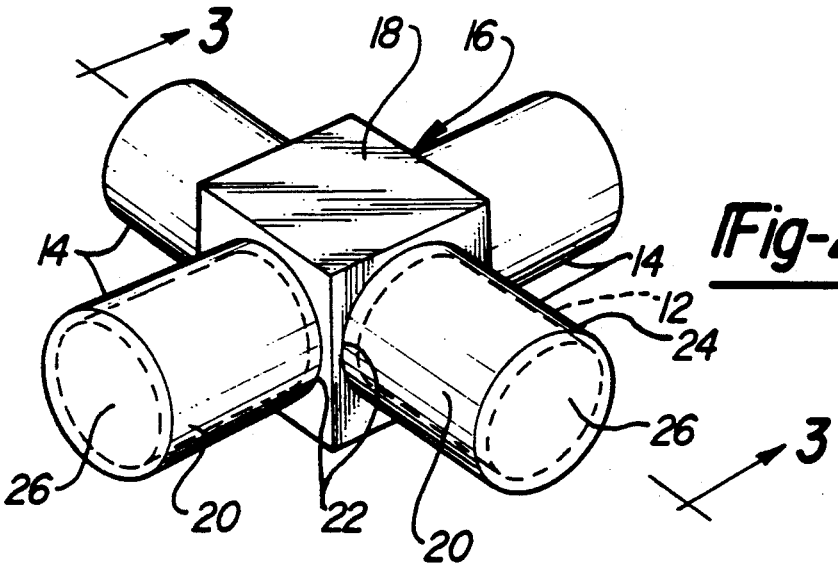
FIG. 2 is an isometric view of one embodiment of a hydrophone according to the invention.
Figure 3:
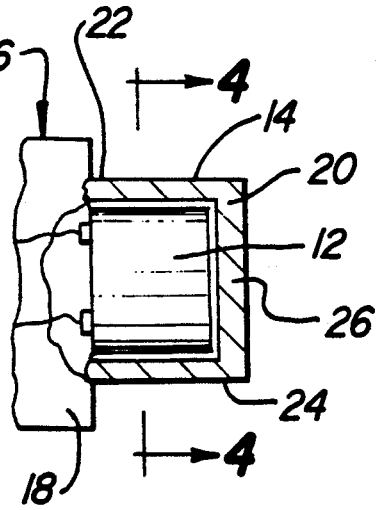
FIG. 3 is an elevational cross section of an arm of the hydrophone taken along line 3—3 of FIG. 2.
Figure 4:
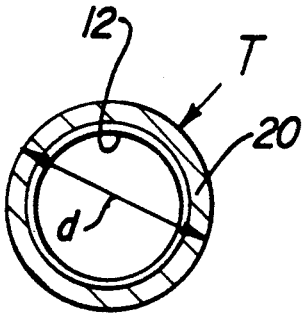
FIG. 4 is cross section of an arm of the hydrophone taken along line 4—4 of FIG. 3.

The invention is applicable to any type of gradient hydrophone, although the directional hydrophone is preferred. As shown in FIGS. 2 through 4, the hydrophone comprises two pairs of geophones 12 disposed in the four arms 14 of a cruciform housing 16. The housing 16 has a central body 18 shown as a cube but it may be another convenient shape such as spherical or cylindrical. Each arm 14 comprises a cylindrical wall 20 having a horizontal axis and having a proximal end 22 attached to the body 18 and a distal end 24 covered by an end cap 26. The wall 20 has a thickness t and an outer diameter d. The force per unit length imposed on the wall by the water pressure is proportional to the diameter d and the wall thickness required to withstand the stress is likewise proportional to the diameter d. It is thus advantageous, in terms of minimizing mass to use small diameter housing parts having thin walls as opposed to thick large diameter walls.

The prior art (FIG. 1) housing diameter is about 3 times the diameter d of the arms 14 of the subject hydrophone. It also has correspondingly large area disk-like top and bottom covers, not shown. In contrast, the small end caps 26 and the walls of the body 18 are much smaller in area than those covers. Thus the structure of the invention can have thinner walls, by a factor of 3 and can have a somewhat smaller wall surface area as well to realize a very significant mass reduction.

Figure 5:
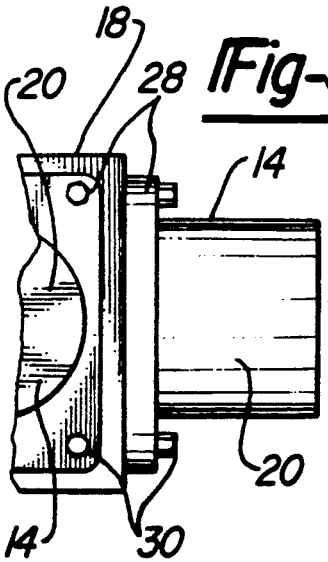
FIG. 5 is a partial elevation of another embodiment of a hydrophone according to the invention.

The embodiment of FIG. 5 has the same overall arrangement as that described above and includes specific structural means for assembly of the housing. In particular, the arms 14 of the housing 16 are separable from the central body 18. Each cylindrical wall 20 terminates at its proximal end in a flange 28 which is configured to mate with and sealingly seat against the central body. Bolts 30 secure the flanges 28 to the body 18. This facilitates assembly of the housing and the internal geophones and is consistent with the object of achieving a low mass, high pressure resistant hydrophone housing.

In the tested embodiment, which is operative at a depth of 20,000 feet, the housing is constructed of light high strength aluminum. The arms are about 4.75 inches across the opposed distal ends and the walls 20 have a diameter d of about 1.6 inches. (This compares to a prior art housing of about 4.75 inches in diameter to house the same size geophones and which was not operative at such depths). The resulting hydrophone has a relatively small mass for such a high pressure resistant device and yields high sensitivity.

It will thus be seen that the invention provides a hydrophone for deep submergence applications and has a low mass housing to allow high sensitivity to sound pressure waves in the water.

The embodiments of the invention in which an exclusive property or privilege is claimed are defined as follows:

1. A hydrophone for underwater deployment and being subject to water pressure comprising:

first and second pairs of geophones arranged in a substantially cross configuration, and a single housing having plural arms in a cruciform configuration and enclosing all of said geophones for sealing them against said water pressure and having:

a) a separate cylindrical wall surrounding each geophone, each wall forming one of said arms of the cruciform housing and having a proximal end and a distal end, b) an end cap closing the distal end of each cylindrical wall, and c) a central body joining the proximal ends of the walls.

2. A hydrophone as defined in claim 1 wherein the diameter of each cylindrical wall is substantially smaller than the width of the cruciform housing.

3. A hydrophone as defined in claim 1 wherein the central body is generally cube shaped and the cylindrical walls are joined to cube faces of the central body.

4. A hydrophone as defined in claim 1 wherein the proximal end of each wall terminates in a flange configured to mate with the central body and the housing includes means for fastening each flange to the body.

* * * * *